United States Patent [19]

Brooke

[11] 4,388,778

[45] Jun. 21, 1983

[54] ENCLOSURE FOR BATHTUB OR SHOWER HAVING SLIDING DOORS

[75] Inventor: Michael E. Brooke, Sharon, Wis.

[73] Assignee: United States Gypsum Company, Chicago, Ill.

[21] Appl. No.: 244,399

[22] Filed: Mar. 16, 1981

[51] Int. Cl.[3] ..... E05D 15/26

[52] U.S. Cl. ..... 49/125; 49/257; 49/411

[58] Field of Search ..... 49/125, 410, 411, 254, 49/257, 260

[56] References Cited

U.S. PATENT DOCUMENTS 3,990,183 11/1976 Meggs et al. ..... 49/125

FOREIGN PATENT DOCUMENTS 255106 2/1963 Australia ..... 49/411

*Primary Examiner*—Kenneth Downey

*Attorney, Agent, or Firm*—Samuel Kurlandsky; Robert H. Robinson; Robert M. Didrick

[57] ABSTRACT

An enclosure for a bathtub or shower having a sliding door assembly and comprising a header or supporting assembly including a front header and a side header operatively connected thereto, each header having a pair of tracks, one for each door, the tracks of the front header communicating with the respective tracks of the side header at a bevel joint, a pair of doors each having hanger assemblies mounted on their upper edge, each hanger assembly having a glider member at its end engaged in one set of said tracks, said doors being adapted to be alternatively positioned in front of the enclosure or to be slid to a storage position along a side wall of the enclosure.

7 Claims, 11 Drawing Figures

ENCLOSURE FOR BATHTUB OR SHOWER HAVING SLIDING DOORS

BACKGROUND OF THE INVENTION (1) Field of the Invention

The present invention relates to enclosures for a bathtub or shower, and more particularly refers to such an enclosure having sliding doors which may be alternatively positioned in the front of the enclosure, or in a storage position at the side of the enclosure.

(2) Description of the Prior Art

Bathtub and shower enclosures are disclosed in the prior art having sliding door assemblies. Conventionally the doors have been slidable in only single sets of tracks so that one may slide them to a closed position or to an open position in front of the enclosure.

In U.S. Pat. Nos. 3,990,183 and 4,089,135 enclosures are disclosed having sliding doors suspended from tracks and having tracks which are mounted both in front and to one side of the enclosure. As a result, the doors may be placed either in a closed position or alternatively, the doors are arranged to permit sliding into out of the way storage positions to facilitate cleaning and easy access to the area closed off by the doors. This is accomplished by means of tracks having pivotal rollers positioned therein and affixed to the upper edge of the door. The pivotal rollers are rather complicated and expensive and create considerable noise when they are caused to pivot around the corners at the intersection of the front track and the side track.

SUMMARY OF THE INVENTION

It is accordingly an object of the invention to provide an enclosure for a bathtub or shower having a sliding door assembly which may be arranged in front of the enclosure, or, alternatively, may be caused to slide to a storage position at the side of the enclosure.

It is an additional object to provide such a structure wherein the doors may be readily changed from one position to the other without causing undue noise.

It is still a further object of the invention to provide assembly of the type described which is relatively inexpensive and easy to fabricate.

Other objects and advantages of the invention will become apparent upon reference to the drawings and details of the description.

According to the invention, an enclosure for a bathtub or shower is provided having a sliding door assembly mounted on straight tracks. One pair of tracks are provided on a front supporting member, and the other pair of tracks are mounted on a lateral supporting member at a side wall, the respective tracks being operationally connected to each other. The doors are suspended by a plurality of assemblies terminating in glider members formed of a low coefficient of friction plastic material and engaged in the tracks. As a result, the doors very readily slide from an operative position to a storage position without undue noise and without snagging.

DESCRIPTION OF THE PREFERRED EMBODIMENT

Figure 1:
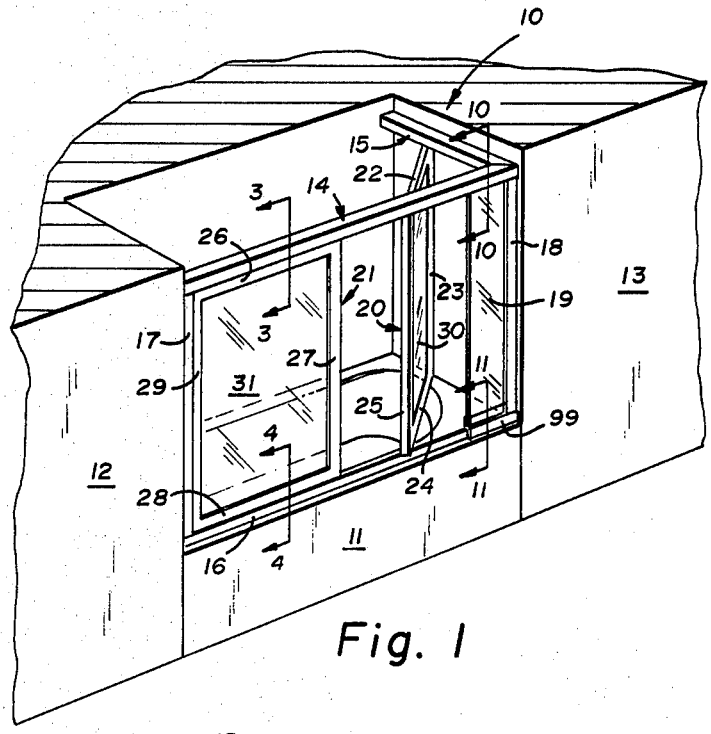
FIG. 1 is a perspective view of a bathtub and enclosure according to the invention.

Referring to the drawings and particularly FIG. 1, a tub enclosure 10 is shown mounted on a bathtub 11 between bathroom walls 12 and 13. A long front header or supporting member 14 is mounted between the walls, and a short header or supporting member 15 is mounted along a side wall. A sill track 16 is mounted on the tub. End jambs 17 and 18 are mounted on the wall. A tempered glass wall 19 is mounted on the end jamb 18 and supported by the header 14 and sill glazing channel 99.

A pair of doors 20 and 21 are mounted on the enclosure, the door 20 comprising door frame members 22, 23, 24 and 25, and the door 21 comprises door frame members 26, 27, 28 and 29. The door 20 has a glass panel 30 and the door 21 has a glass panel 31.

Figure 2:
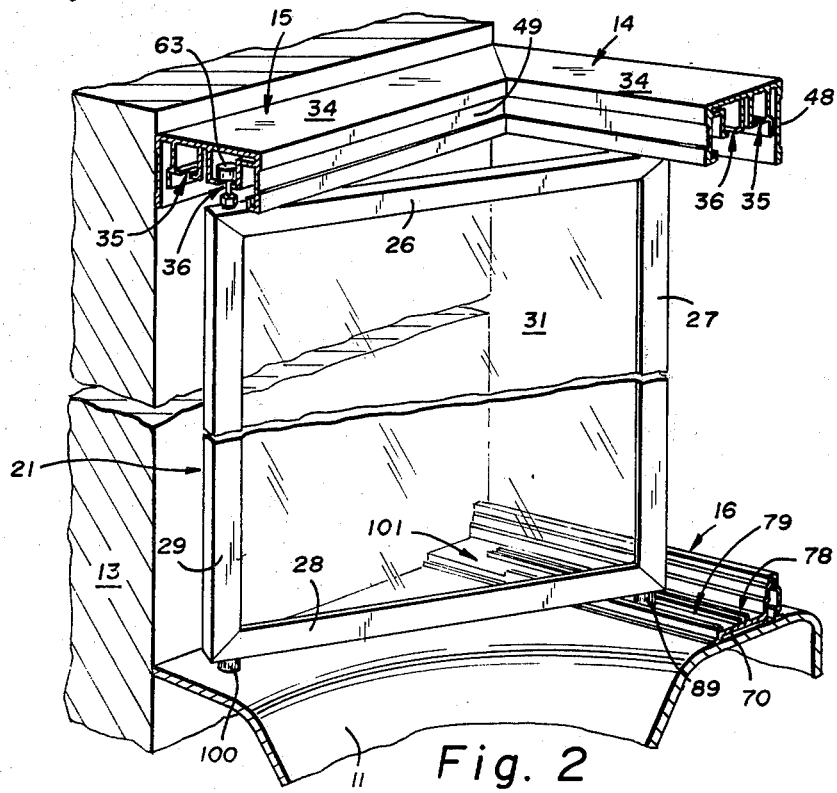
FIG. 2 is a fragmentary perspective of a corner of the enclosure.
Figure 3:
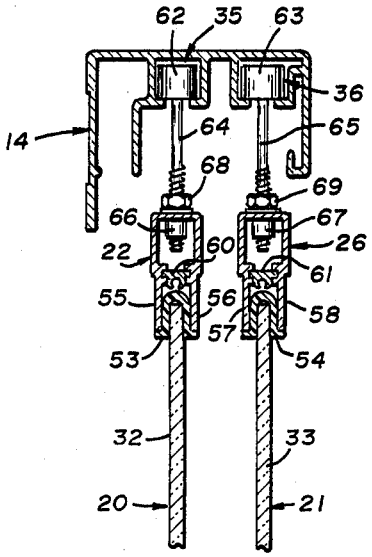
FIG. 3 is a cross-sectional view taken at the line 3—3 of FIG. 1, looking in the direction of the arrows.
Figure 5:
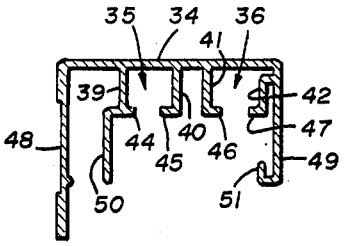
FIG. 5 is a cross-sectional view of a header or supporting member.

Referring to FIGS. 2, 3 and 5, the headers 14 or 15 are shown in cross-section and comprise top web 34 and head tracks 35 and 36 defined by flanges 39, 40, 41 and 42, having transverse lips 44, 45, 46 and 47, respectively. A vertical front panel 48 is connected at the front edge of the web 34 and the vertical rear panel 49 is connected to rear edge of the web 34. A glass panel-supporting flange 50 is connected to the flange 39, and a miter clip restraint 51 extends from the vertical rear panel 49.

Referring particularly to FIG. 3, the doors 20 and 21 are shown supported by the tracks 35 and 36 of the long header 14 or the short header 15. The upper frame members 22 and 26 are shown having frame member flanges 55 and 56, and 57 and 58, respectively. Gaskets 53 and 54, respectively hold the glass panels 32 and 33, respectively in the doors. The remainder of the frame members support the glass panels in the same manner. The slide-in bosses 60 and 61, respectively engage screws for retaining the mitered corners of the frame members.

The doors are supported by means of glider members 62 and 63 in the form of cylinders engaged in the head tracks 35 and 36, respectively, and supported by the lips 44, 45, 46 and 47. Machine screws 64 and 65 are positioned in a central opening of the glider cylinders, and the machine bolts are affixed to the frame members 22 and 26 by means of blind RIVNUTS 66 and 67 and hex nuts 68 and 69. RIVNUT fasteners are trademarked products of B. F. Goodrich, and are tubular rivets with internal threads.

Figure 6:
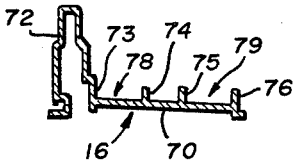
FIG. 6 is a cross-sectional view of a sill track.
Figure 4:
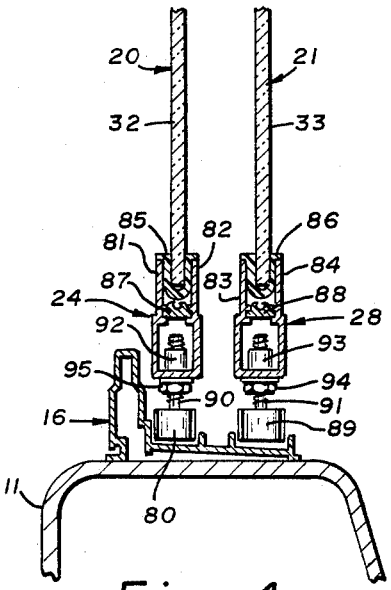
FIG. 4 is a partial view in cross-section taken at the line 4—4 of FIG. 1, looking in the direction of the arrows, showing the means for guiding the lower portions of the doors.
Figure 7:
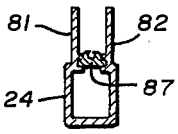
FIG. 7 is a cross-sectional view of a lower door frame member.

Referring to FIGS. 4, 6 and 7, the lower portion of the assembly is shown and comprises a sill track 16 mounted on the rim of the bathtub 11.

As shown in detail particularly in FIG. 6, the sill track 16 comprises a web 70, a front wall 72, and vertical guides 73, 74, 75 and 76 extending from the sill web 70. The vertical guides form guide channels 78 and 79.

Referring to FIG. 4, the frame members 24 and 28 are shown having flanges 81, 82, 83 and 84 and gaskets 85 and 86 retaining the lower edges of the glass panels 32 and 33. Slide-in bosses 87 and 88 are mounted in grooves provided in the frame members and serve to engage screws retaining the mitered corners of the door frame members together. The lower portions of the door are restrained laterally by glider cylinders 80 and 89 having machine bolts 90 and 91 disposed through the axis thereof, engaged in apertures provided in the bottom of the frame members and held in place by means of blind RIVNUTS 92 and 93 and hex nuts 94 and 95. The glider cylinders 80 and 89 restrain the lower portions of the doors only laterally in a front to back direction, and not vertically, whereas the glider cylinders 62 and 63 restrain the doors both vertically and laterally.

Figure 8:
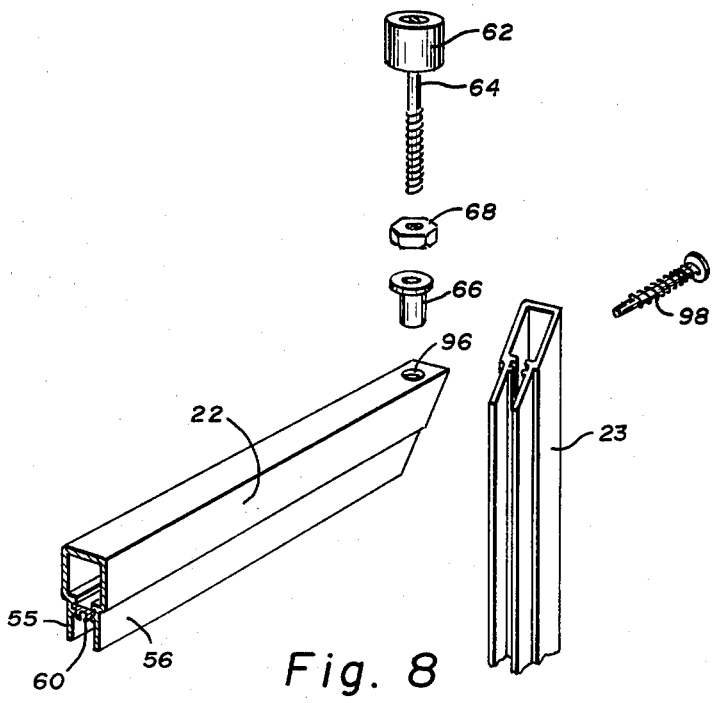
FIG. 8 is a perspective exploded partial view of a pair of door frame members and a hanger assembly.

Referring to FIG. 8 the methods of construction of each corner of each door frame is shown wherein a screw 98 is placed through an aperture (not shown) in the door frame 23 and threadedly engaged in the aperture of a slide-in boss 60. The machine screw 64 having a glider cylinder 62 affixed at its end is threaded into a blind RIVNUT 66 which is placed in an aperture 96, and then maintained in place by means of a hex nut 68.

Figure 9:
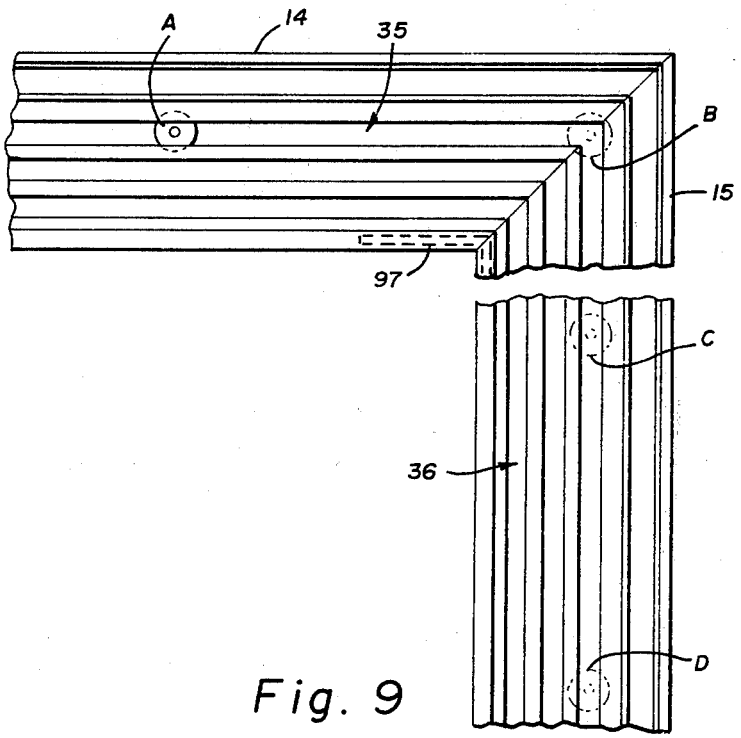
FIG. 9 is a partial view looking upwardly at the junction of the long header and short header illustrating how the structures travel in the tracks and transfers from one track to another.

Referring to FIG. 9, the glider cylinders are shown engaged at the upper portion of the assembly, slide along the head track 35 or 36 and cross from one header to another. The glider cylinder such as 62 is first shown at position "A". As the door slides it reaches position "B". When at position "B", a very light twist of the door causes the glider cylinder to enter the track of the other header and to slide to positions "C" and "D", at which position the doors is in a storage position. The glide cylinders are preferably formed of a plastic material having a low coefficient of friction. Consequently it is not necessary that they turn on the machine bolts. A mere transposed sliding motion offers little resistance to the sliding of the doors.

Also shown in FIG. 9, a miter clip 97 serves to hold the mitered members of the headers together. The miter clip is engaged in the partial slot formed by the miter clip restraint 51 and the flange 42.

Figure 10:
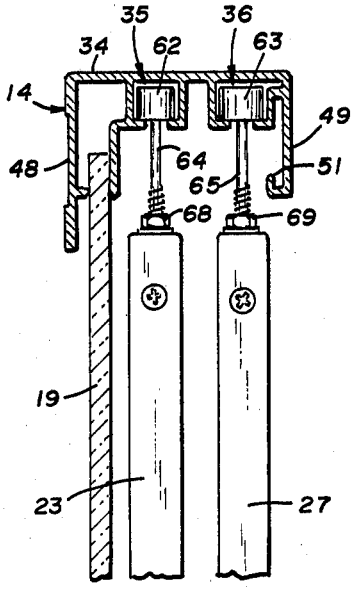
FIG. 10 is an upper end partial view partly in cross-section showing a glass panel in place.
Figure 11:
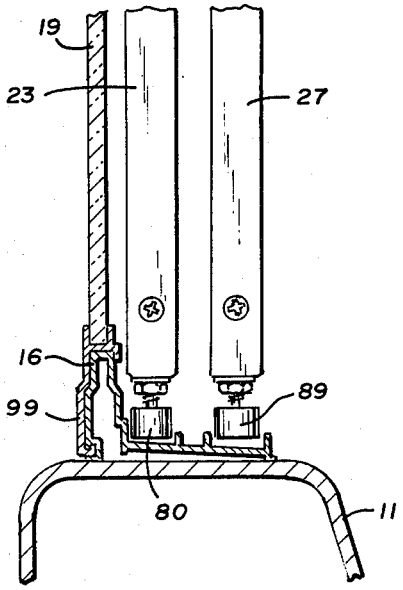
FIG. 11 is a lower end partial view partly in cross-section also showing a glass panel in place.

Referring to FIGS. 10 and 11, the structure is shown supporting a glass panel 19. In practice the doors are made of a standard width. The glass panels are provided in an assortment of widths to complete the coverage of the width of the enclosure, and are provided in many different widths to be utilized in enclosure openings of different widths. The glass panel may be placed at one side of the opening, preferably at the side where the doors are stored, or, alternatively, may be placed on the other side. Alternatively, two panels may be utilized with exceptionally wide enclosure openings, one on each side of the doors.

In operation the doors of the present enclosure may be moved to the left or to the right to open the enclosure or to close it. The glider cylinders which support the doors and ride in the tracks in the headers exhibit only very low friction and may be readily moved from one position to another. When it is desired to place the doors in the storage position along one of the walls, the outer door is first moved to the side where it is to be stored. When the foremost glider cylinder reaches the extreme end of the long header 14 and encounters the track of the short header 15, a very slight twisting force is applied to the door and the glider cylinder enters the track of the short header. The door then begins to fold as shown in FIGS. 2 and 9. The foremost glider cylinder 100 leaves the sill track 16 at its end having a cut away portion 101 of the sill track. The bottom of the door is adequately guided by the upper glider cylinders which always remains in its track. After the outer door has been completely folded in against the side wall, the inner door is then moved and similarly placed in position against the side wall. The entire entrance of the enclosure is then completely opened and the enclosure may be cleaned or otherwise treated without interference from the doors.

The present invention is relatively inexpensive since it utilizes straight extruded members having straight tracks, and does not require a curved track to transfer the glider cylinders from one track to another. The headers may be cut to the proper size with a bevel cut and readily engaged by means of the miter clips 97. The headers and integral tracks may be readily formed by extrusion, thereby greatly reducing the cost of the structures.

The enclosure assembly of the present invention has a number of advantages. The use of a glider assembly comprising the glider cylinders and tracks provide a low friction combination which provides quiet and smooth operation. The glider cylinders ride in head tracks which have only small horizontal lips and therefore do not catch water or dirt. The tracks are sturdy and the slot openings of the tracks prevent water and dirt from building up. Structures disclosed in the prior art have deep troughs to support the rollers and therefore permit water and dirt to build up, which eventually impairs proper operation. The sill track merely acts as a guide for the glider cylinders to be guided by and does not support the doors. The front wall 72 prevents water from splashing out of the tub. The vertical guides 73, 74, 75 and 76 defining the guide channels 78 and 79 are very shallow and do not provide a trap for accumulating dirt and water. The headers containing the tracks may be formed as integral extrusions. They may be supplied in stock lengths, and cut to the proper length and mitered at the job site. They are simply assembled by means of the miter clip 97 and engaged into slots provided in the end jambs 17 and 18. The glider cylinder may be fabricated from "DELRIN", a trademarked product manufactured by DuPont. The material is a high density nylon exhibiting very high stretch and abrasion resistance and a low coefficient of friction. Additionally, the doors may be provided in standard sizes with the remainder of the enclosure opening being covered by means of glass panels which slide in slots provided in the header. The lower edges may be retained by means of an adapter 99 mounted on the sill front wall 72.

It is to be understood that the invention is not to be limited to the exact details of construction or operation or materials shown and described, as obvious modifications and equivalents will be apparent to one skilled in the art.

Invention is claimed as follows:

1. A sliding door assembly for a bathtub or shower enclosure, comprising a first support member, a second support member and a pair of sliding doors slidably supported by said support members, said first support member being arranged to support said doors at the front of said enclosure, and said second support member being arranged perpendicular to said first support member and arranged to support said doors at the side of said enclosure in storage position, each of said support members comprising a frame having a pair of longitudinally arranged spaced-apart tracks, each of said tracks comprising a pair of spaced-apart depending flanges having flat lips at their lower edges, the lips of each pair of flanges being directed toward each other and substantially perpendicular to said depending flanges, said depending flanges and said lips cooperating to define a track channel and a constricted slot, the track channels and constricted slots of each track of said first support member communicating with corresponding track channels and constricted slots of said second support member, each of said doors having a pair of spaced-apart supporting means mounted at the upper edge thereof, each of said supporting means comprising an elongate member affixed at one end to the upper edge of said door, and having a cylindrical glide member of circular cross-section affixed to the other end thereof, said glide members being slidably disposed within said track channel and supported by the lips of said track and arranged to support said doors, said elongate means extending through said constricted slot, said glide members being slidable within said track channels and being transferable from the track channels of said first supporting member to the track channels of said second supporting member, whereby said doors may be moved for opening and closing said enclosure opening when engaged in the tracks of said first supporting member, and may be transferred to the tracks of said second supporting member for storage.

2. A sliding door assembly according to claim 1, wherein said glide members are formed of a plastic material having a low coefficient of friction.

3. A sliding door assembly according to claim 1, wherein one end of each supporting member is cut at substantially 45° to form a beveled end, and said beveled ends are joined together.

4. A sliding door assembly according to claim 1, wherein each supporting member and the tracks associated therewith are formed as an integral extrusion.

5. A sliding door assembly according to claim 1 wherein said doors are formed of frame members enclosing a glass panel.

6. A sliding door assembly according to claim 1, additionally having a sill member mounted at the lower portion thereof having shallow grooved tracks, said doors having guide members provided at the lower edge thereof engaging said tracks to prevent lateral movement of said doors at the bottoms thereof.

7. A sliding door assembly according to claim 6, wherein said guide members at the lower edges of said doors are cylindrical and formed of a plastic material having a low coefficient of friction.

* * * * *